US006659287B1

(12) United States Patent
Hawkins

(10) Patent No.: US 6,659,287 B1
(45) Date of Patent: Dec. 9, 2003

(54) APPARATUS AND METHOD FOR GRADING ARTICLES

(75) Inventor: Stanley E. Hawkins, Exeter, CA (US)

(73) Assignee: Exeter Engineering, Inc., Exeter, CA (US)

( * ) Notice: Subject to any disclaimer, the term of this patent is extended or adjusted under 35 U.S.C. 154(b) by 0 days.

(21) Appl. No.: 09/011,704

(22) PCT Filed: Aug. 15, 1996

(86) PCT No.: PCT/GB96/01998

§ 371 (c)(1),
(2), (4) Date: Aug. 13, 1999

(87) PCT Pub. No.: WO97/06898

PCT Pub. Date: Feb. 27, 1997

(30) Foreign Application Priority Data

Aug. 16, 1995 (GB) ..... 9516793

(51) Int. Cl.[7] ..... B07C 5/02

(52) U.S. Cl. ..... 209/538; 209/650; 209/652; 209/912; 198/483.1

(58) Field of Search ..... 209/538, 576, 209/650, 652, 654, 701, 912, 941; 198/482.1, 483.1

(56) References Cited

U.S. PATENT DOCUMENTS

| | | | | | |
|---|---|---|---|---|---|
| 2,636,603 | A | * | 4/1953 | Feick et al. | 209/941 X |
| 3,004,666 | A | * | 10/1961 | Hack | 209/941 X |
| 3,315,781 | A | * | 4/1967 | Eberman et al. | 198/483.1 |
| 3,669,239 | A | * | 6/1972 | Martin | 198/483.1 |
| 4,273,496 | A | * | 6/1981 | Papalexis | 198/483.1 X |
| 5,280,838 | A | * | 1/1994 | Blanc | 209/652 X |
| 5,497,887 | A | * | 3/1996 | Hiebert | 209/912 X |

* cited by examiner

*Primary Examiner*—Tuan N. Nguyen
(74) *Attorney, Agent, or Firm*—Jensen & Puntigam P.C.

(57) ABSTRACT

An apparatus and method for inspecting and sorting articles such as fruit and vegetables in which the articles are presented, on a conveyor, under a viewing device and classified. A take-off position is determined from the classification and the article is removed by means of an independently actuated ejector mechanism.

37 Claims, 8 Drawing Sheets

APPARATUS AND METHOD FOR GRADING ARTICLES

TECHNICAL FIELD

This invention relates to a method of and apparatus for automatically sorting articles and more particularly to a method and apparatus for automatically sorting articles such as harvested fruit and vegetable crops in accordance with their shape, size and the presence and seriousness of defects.

It has been conventional practice when sorting such articles to establish the grades required and the criteria for each grade in advance of the sorting operation and then for workers to manually randomly sort produce in accordance with the pre-determined grades. The disadvantage of such a system is that it is necessarily labour intensive and accordingly costly.

An object of the present invention is to provide improvements in relation to one or more matters discussed herein and/or generally.

According to the invention there is provided apparatus for grading articles such as fruit and vegetables, and a method of grading articles such as fruit and vegetables as defined in the accompanying claims.

SUMMARY OF THE INVENTION

In an embodiment of the invention apparatus for inspecting and sorting articles such as fruit and vegetables comprises a spool or roller conveyor onto which articles are presented from a discharge chute. The discharge chute may oscillate to assist alignment and movement of the articles discharged onto the conveyor. The conveyor carries the objects under a viewing device or inspection zone at which a camera-type scanning unit is mounted overhead of the conveyor in such a way that the camera can scan the articles as they pass underneath. The roller elements of the conveyor are driven to rotate during the scanning process in order that the articles thereon also rotate to afford as full a view as possible of the articles.

Apparatus such as a video grabber converts the visual image data provided by the camera. This information is passed to a central processing unit which analyses and evaluates the images of the individual article created by the camera as to size (length/diameter/volume), grade (rot, cracks, damage etc) and orientation as well as position in the direction of travel and the space occupied on the conveyor as the article sits in the valleys formed between successive roller elements. Any defects present are characterised into groups in accordance with pre-determined characteristics and converted into a numerical value, such as a percentage. An operator establishes, by means of a set-up screen, the required characteristics or numerical value of the particular grade to be selected for. The operator controlled program then establishes a discharge position where selected articles will be removed from the conveyor according to the required classification, that is by size, grade or direction of orientation. The central processing unit would determine the point at which the selected article is to be removed and how many actuators to activate to cause article removal devices or flip levers located just under the full length of the product to flip the article onto the take out conveyor or flume.

Tracking means mazy ho provided on the conveyor so as to enable the position of each article to be followed, thus facilitating removal of the particular article from the conveyor on reaching the required discharge position.

Articles may be removed or ejected from the conveyor at the required position by article removal devices. A plurality of devices may be provided and mounted at intervals between the roller elements and across the width of the conveyor. The devices comprise a flip lever.

In another embodiment of the invention said article removal elements may be in the form of projections. Said projections may be of finger-like form. The finger-like projections may be inclined forwardly with respect to their direction of angular movement when actuated.

In a further embodiment of the invention the flip levers may be shaped, for example, diablo shaped, to suit the particular type of articles being graded such as citrus fruits.

The flip lever may be pivotally mounted beneath the conveyor. Each flip lever, when activated, moves in an upward direction and passes between two successive pairs of roller elements to contact an article lying on the conveyor. The upward momentum imparted to the article as a result of contact between the flip lever combined with the forward momentum from the roller conveyor causes the article to be carried upwardly, or "flipped" onto a discharge belt or flume while the flip lever retracts.

Transverse overhead take-out conveyors or water flumes are provided to collect and deliver to the side of the machine those articles which are removed from the conveyor when the required position is reached. The articles are flipped up and into the take-out conveyor or flume by the flip levers in the roller conveyor system.

In an embodiment two or more article removal devices such as flip levers may be provided for each article to be removed, wherein the size of the article may determine the number and/or sequence of elements which are actuated at any one time.

Those articles remaining on the conveyor will be discharged over the end of said conveyor. In most cases these articles will represent the prime grade required.

Any number of discharge belts and corresponding ejector mechanisms may be provided depending on the number of classifications required during a given. operation.

A typical machine will have three take-out positions with the required ejector mechanisms and discharge belts in addition to the over the end separation point making a total of four although any number of take-out points may be provided, It is envisaged that the take-out points will be of modular construction and the length of the machine may be extended by adding further such points. It is also envisaged that the apparatus herein before described will replace the conventional inspection conveyor normally positioned between the station for washing/sorting of articles and packing which is generally manned by a number of people.

According to the invention there is also provided a method for inspecting and sorting articles such as fruit and vegetables, said method comprising the step of locating the articles on a conveyor for example by discharging the articles from a chute onto a spool or roller conveyor. The chute may be caused to oscillate to assist alignment of the articles. The articles on the conveyor pass under a viewing device or inspection zone at which the articles are inspected and scanned as they pass. The method comprises the step of analysing an image or other data from each article by a data processing and control system, said data being processed in order to classify the articles according to shape and/or size and/or defects. The method comprises the step of causing a selection of said classified articles to be removed or ejected from the conveyor in response to said classification. During the step of removal or ejection, the article is caused to be lifted from the surface of the conveyor and moved to a discharge conveyor.

An advantage of the invention described herein is that it provides a faster, less labour intensive and accordingly a more economical method for sorting articles such as fruit and vegetables.

BRIEF DESCRIPTION OF THE DRAWINGS

Embodiments of the present invention will now be described by way of example with reference to the accompanying drawings in which.

BEST MODE FOR CARRYING OUT THE INVENTION

Figure 1:
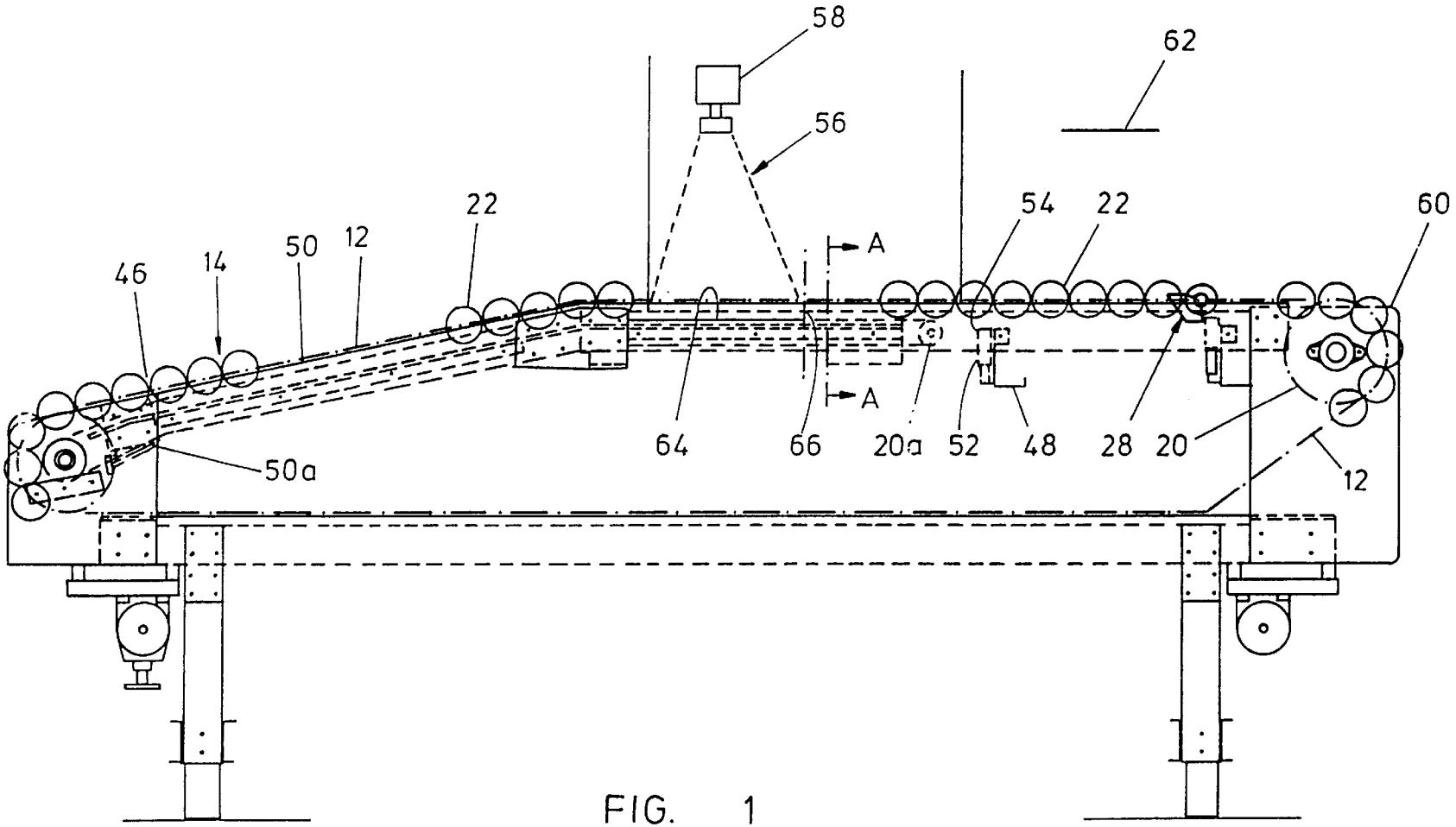
FIG. 1 shows a side elevation view of the inspecting and sorting apparatus according to the invention.
Figure 2:
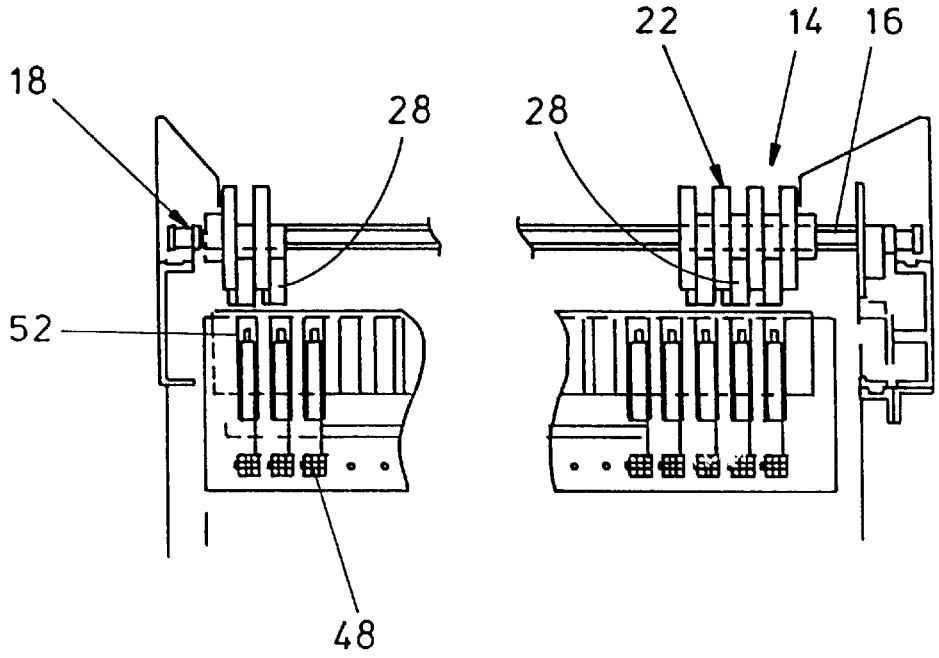
FIG. 2 shows a sectional view taken along the line A—A of the apparatus of FIG. 1.
Figure 3:
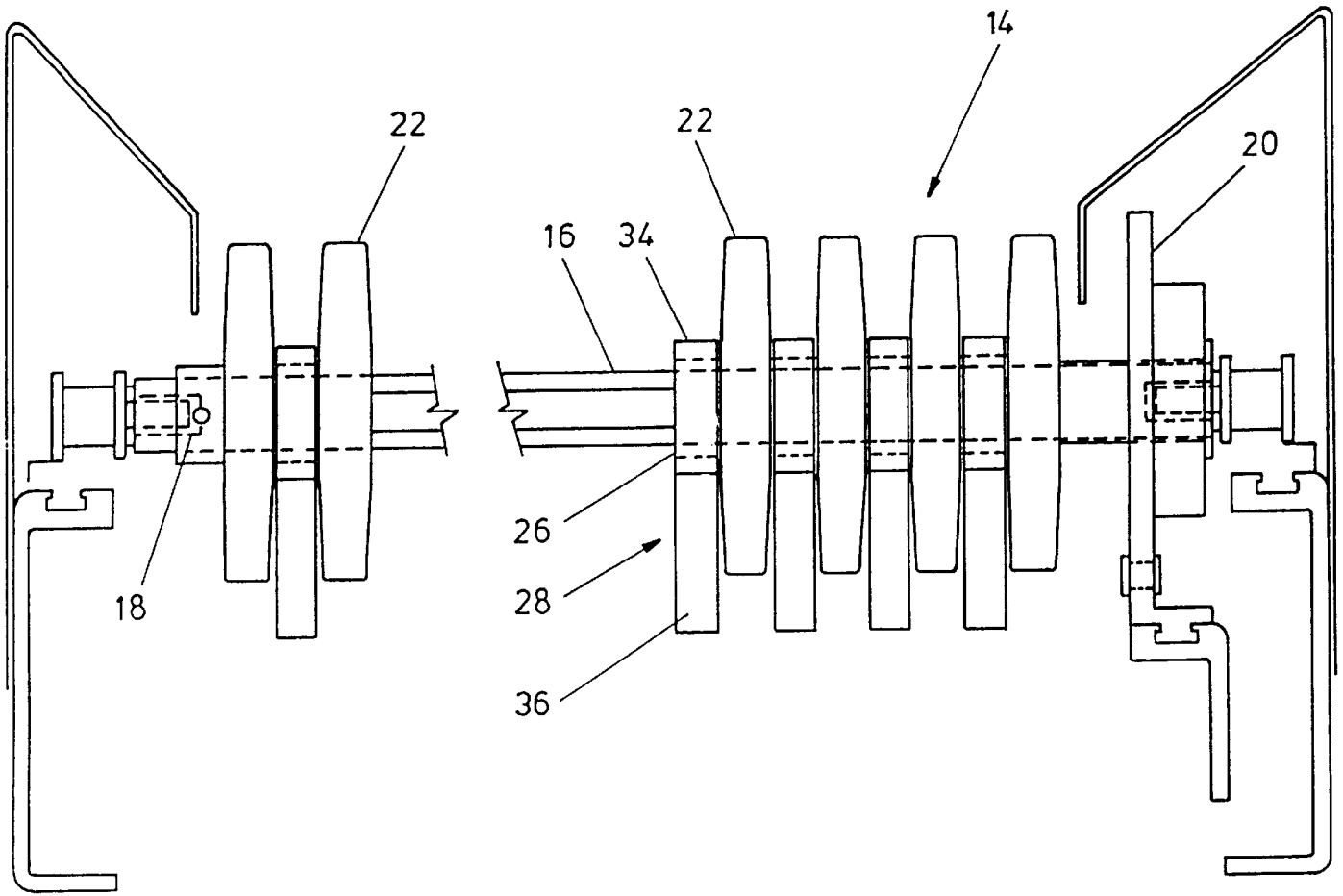
FIG. 3 shows a side elevation view of a section of a roller assembly according to the invention.
Figure 4:
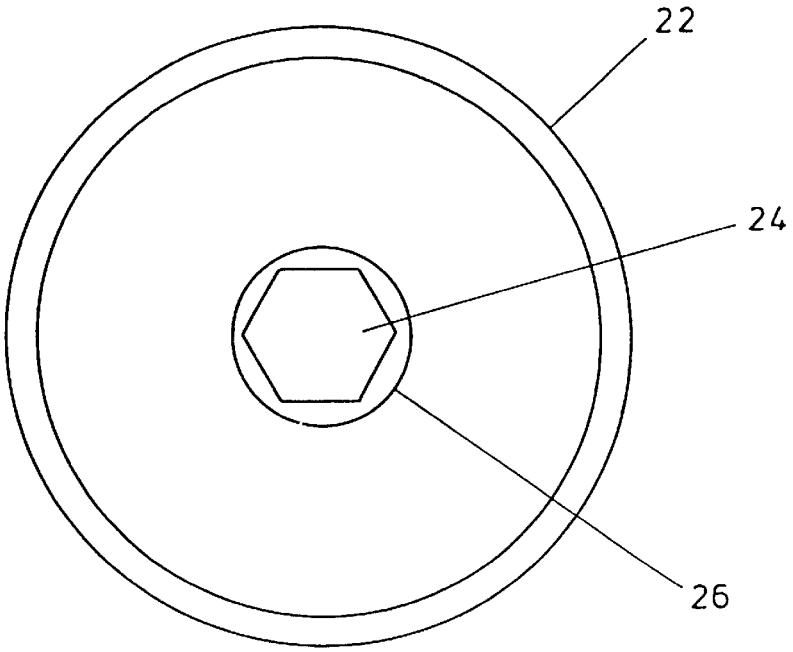
FIG. 4 shows a side elevation view of a flip lever.
Figure 5:
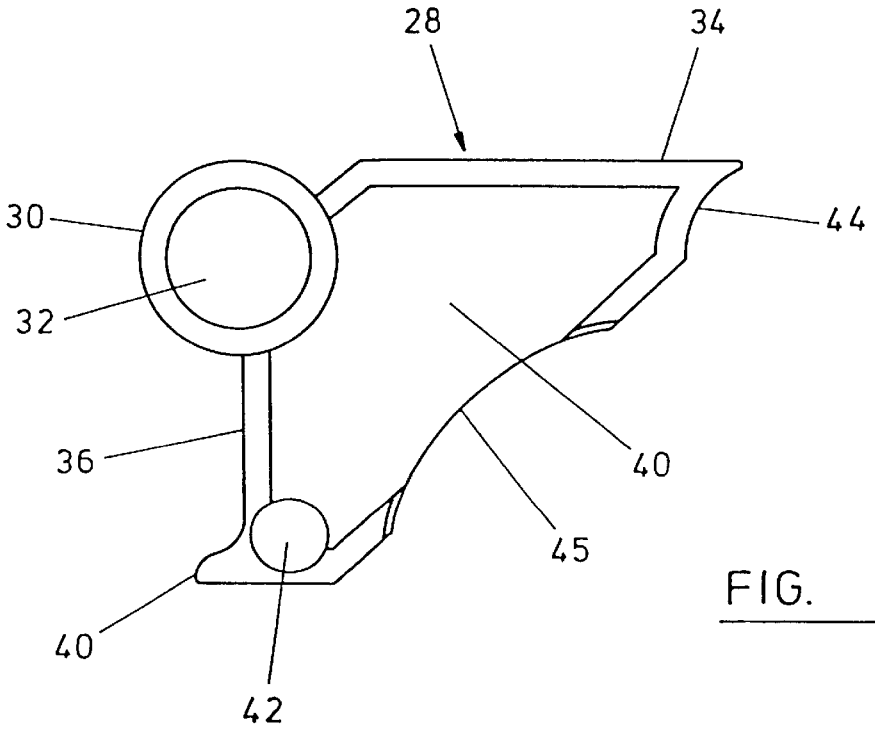
FIG. 5 shows a side elevation view of a roller element.
Figure 6:
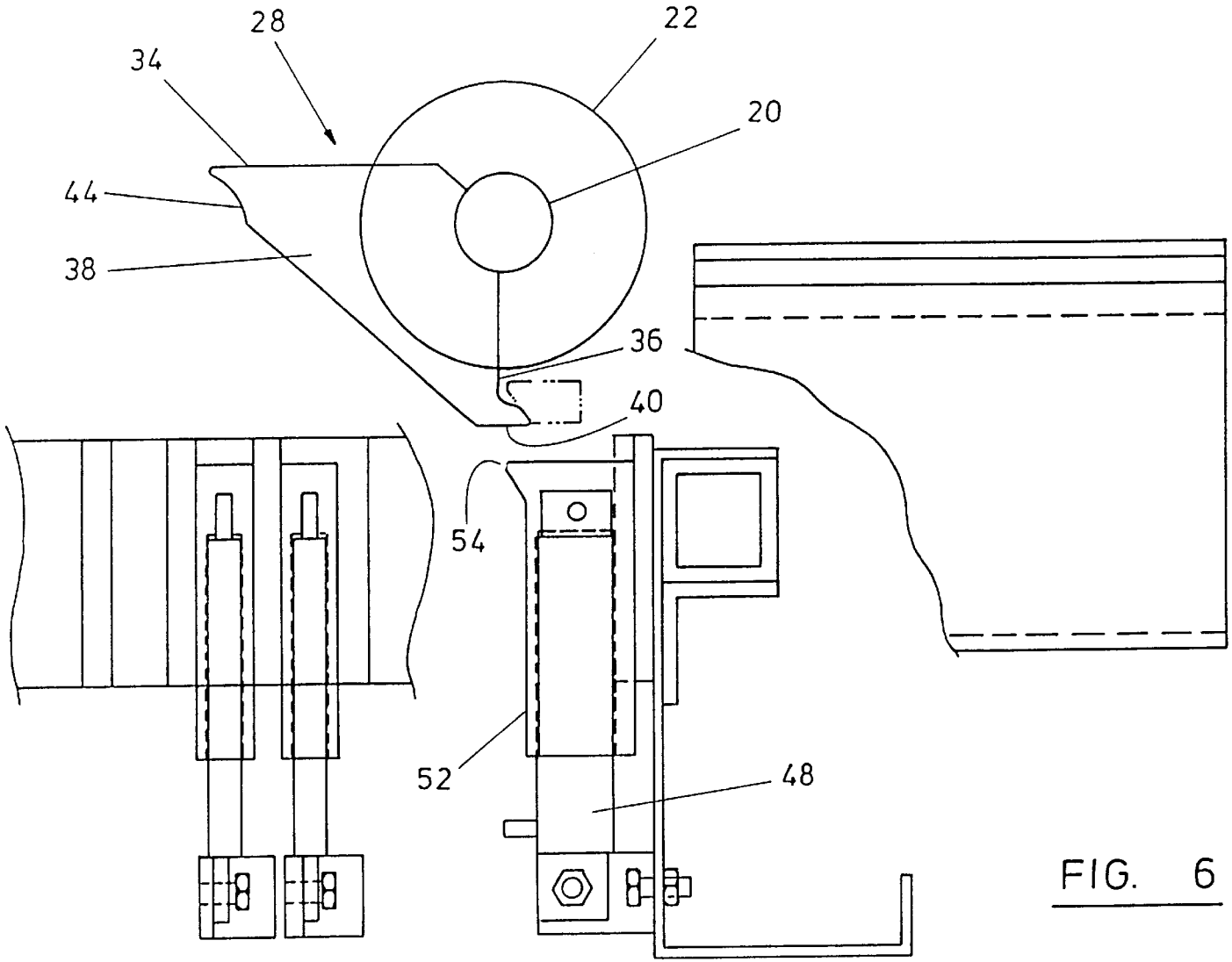
FIG. 6 shows a side elevation view of a roller element, flip lever and associated actuating means.
Figure 7:
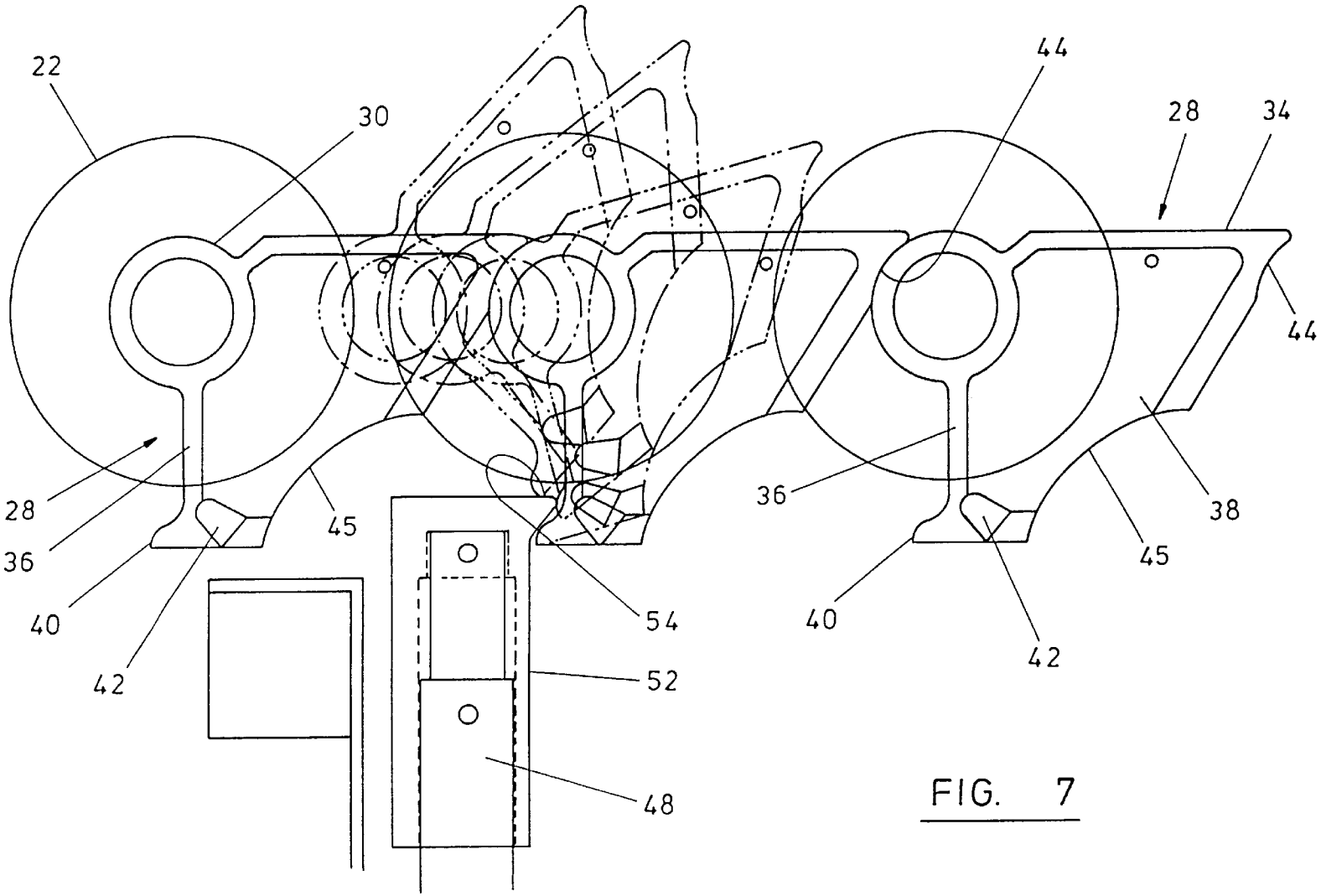
FIG. 7 shows a side elevation view of three flip levers and associated roller elements, showing the position of the flip levers in relation to one another and the movement of a flip lever.
Figure 8:
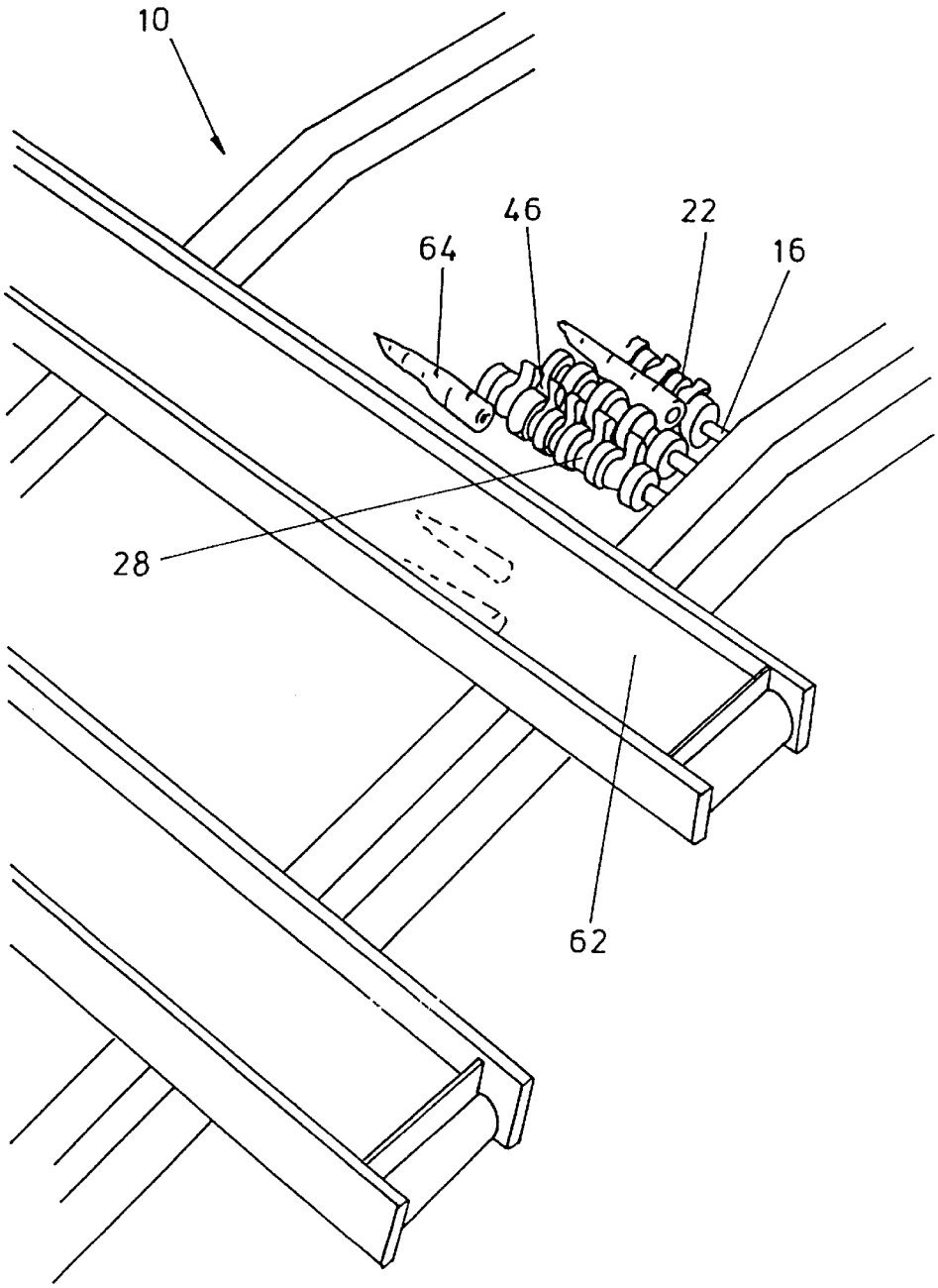
FIG. 8 shows a side elevation view, schematic in character of a portion of the apparatus according to the invention showing the position of an article to be sorted in relation to the roller elements and flip levers.
Figure 9B:
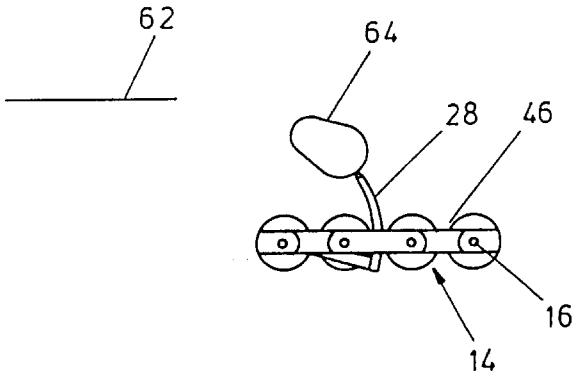
FIGS. 9*a*–9*d* show a side view, schematic in character of the action of an alternative flip lever.
Figure 9D:
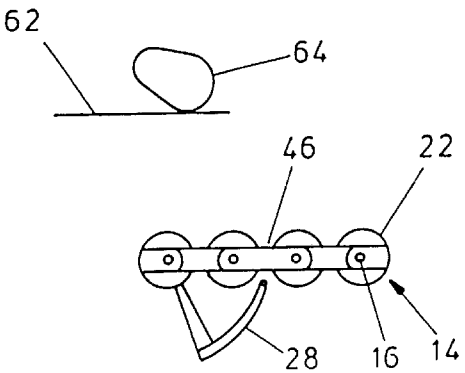
Figure 9A:
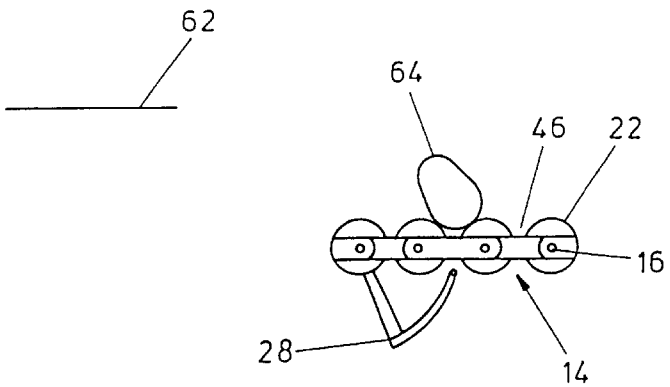
Figure 9C:
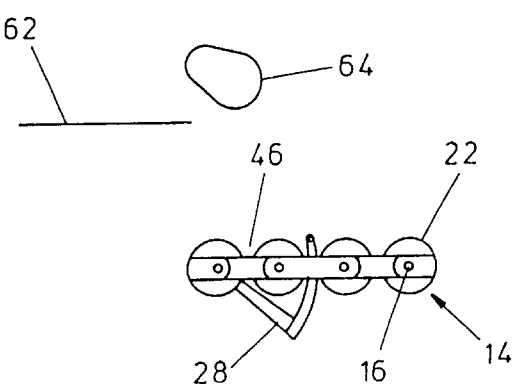

As shown in the drawings, apparatus for conveying and inspecting articles 10 comprises a spool or roller conveyor 12. Said roller conveyor 12 comprises a series of roller assemblies 14. Each roller assembly 14 is formed by mounting a plurality of roller elements on a hexagonal steel shaft 16 having bushings 18 at each end and a sprocket 20 attached near one end. The roller elements 22 comprise disc shaped rollers with a central aperture 24 which is hexagonal to enable them to be received on the shaft 16, and a round hub portion 26 on one side.

The aperture 24 could be of any other suitable shape such as triangular, pentagonal, or square but in practice a roller element 22 with a hexagonal-shaped aperture mounted on a correspondingly shaped shaft provides the best drive. Also mounted on the shaft 16 and between the roller elements 20 is a flip lever 28. Said flip lever 28 comprises a round portion 30 having an aperture 32 which is round for receiving the hub 26 of the roller element 20, a substantially horizontally extending arm or lever portion 34 and a substantially vertically extending leg portion 36, all of which may be moulded as a single body 38 to provide the flip lever 28 with additional strength.

The aperture 32 may be formed off-centre with respect to the body portion 38 of the flip lever 28. The arm portion 34 of the flip lever 28 extends in a direction opposite to that of the flow of items on the conveyor 12 (ie upstream) and extends towards and rests in the region of the top of the pivot point of the following flip lever 28 located on the next shaft 16. The body portion 38 is shaped in the region of contact 44 to accommodate the round portion 30 of the following flip lever 28. The leg portion 36 extends in a downwardly direction below the conveyor 12.

The flip lever 28 is constructed such that the arm portion 34 is below the upper edge of the roller elements 22, such that the upper face of the arm portion 34 is positioned just below the articles (such as fruit/vegetables to be graded) as these lie in valleys 46 formed by and between the rollers elements 22 of successive roller assemblies 14. Smaller size or diameter articles may lie directly on top of the upper face of the arm portion 34. The leg portion 36 of the flip lever 28 extends in a downward direction past the bottom of the roller elements 22. By extending downwardly below the conveyor 12, the leg portion 36 may be actuated by suitable actuating means 48 positioned beneath the flip lever 28. The leg portion 36 is also formed with an stop or lug portion 42.

The roller assemblies 14 are attached at their end points to drive chains 50 which pass over the sprockets 20 located at the end of the conveyor 12. An electric motor drives the sprockets 20 at the discharge end of the conveyor 12. As the motor drives the sprockets 20, the chains 50 on each side of the roller conveyor 12 advance, along with all of the roller assemblies 14 which are carried perpendicularly between the chains 50.

By alternately installing a roller element 22 then a flip lever 28 on the shaft 16, a flip lever/roller assembly 14 may be created of any axial length. A shaft collar will be used on each end of the shaft to hold the assembly together. The length of the hub 26 and diameter of the roller element 22 is such that the flip lever 28 is free to rotate on the hub 26.

The bushings 18 at the ends of the shafts 16 are used to connect pins on standard pin chain which is used to form the conveyor 12. In this manner, the shaft 16 assembly is free to rotate on the chain pins. The endless chains on each end of the shaft 16 are carried by a plastic chain support guide as they advance.

The sprockets 20 mounted on the end of each shaft 16 may be driven by a spin chain system 50*a* driven independently to the main chain 50. The spin chain moves over a solid support guide 64 which raises the chain 50*a* to engage with the sprockets 20. This causes rotation of the sprockets 20 and the roller elements 22 up the in-feed section and under the camera 58, and the entire roller assembly 14 may be rotated at whatever speed is desired. The flip levers 28, being free on the hubs 26 of the roller elements 22, are not rotated by the drive to the shaft 16. The roller elements 20 stop rotating after the last view when the guide 64 is lowered at position 66 to disengage the chain 50*a* before the chains run onto the sprocket 20*a*.

Actuating means for the flip levers 28 are positioned beneath the roller conveyor 12, transverse to the direction of flow, with one rank or array of actuators for each take-off position desired. The actuators would comprise pneumatic, solenoid or other suitable devices that move an actuating cylinder, block or ramp 52 into a position in the path of the leg portion 36 of the respective flip lever 28. Said cylinder 52 is formed with a flange or boot portion 54.

Actuation of the cylinder 52 causes it to move in an upwardly direction towards the conveyor 12. Upward movement of the cylinder 52 results in the flange or boot portion 54 extending past the downwardly extending leg portion 34 of the flip lever 28, such that the two come into direct contact, with the cylinder 52 and flange or boot 54 acting as a trip lever. The flange or boot 54 contacts a correspondingly shaped lip or flange 40 on the leg portion 34 of the flip lever 28. On contact, the flip lever 28 is temporarily prevented from advancing forwardly, but the continued forward movement of the roller assembly 14 on which the flip lever is mounted, causes the flip lever 28 to turn on the hub 26 of the corresponding roller element 22, slowly at first and then with increasing angular acceleration as the forward movement of the roller assembly 14 continues.

The angular movement of the flip lever 28 causes the arm portion 34 thereof to rotate forwardly and contacts an article located on the conveyor 12. Such contact causes the article to be lifted or "flipped" away from the conveyor 12. This lifting action, together with the forward speed of the conveyor, results in an article being lifted upwardly and forwardly from the conveyor 12 onto an appropriate cross conveyor or flume 62. Angular movement of the flip lever 28 continues until the stop portion 42 contacts a roller element 22 located on the following roller assembly 14. The contact between the stop means 42 and the roller element 14 halts the angular movement of the flip lever and said flip lever retracts to its non-actuated position. The body portion 38 of said flip lever 28 is shaped in the region 45 to prevent the flip lever 28 fouling the corresponding roller element when said flip lever 28 is actuated.

In use, the typical operation of the invention is described below. A in-feed delivery unit feeds the articles to be graded and sorted evenly across the width of the roller conveyor 12. Such devices will deliver the articles from conveyors or elevators and cause them to be evenly spread and properly positioned for effective filling of the valleys 46 on the roller conveyor 12.

The articles are delivered in a continuous flow to the delivery unit where they are positioned so that as the roller conveyor 12 advances underneath, the products can drop into the valleys 46 formed between each roller assembly and will fill the valleys 46 formed between the roller assemblies 14 across the width of the conveyor 12.

Excessive volume of articles would cause "doubles" to occur so it is important the feed rate is such that excessive "doubling" (two articles in one valley 46, or overlapping) does not occur. The roller assemblies 14 are driven by their sprockets 20 at any speed of forward or reverse rotation (with respect to the conveyor's travel direction) to assist in filling the valleys 46, ensuring singulation and preventing doubles.

As the articles are delivered on to the roller conveyor 12, the roller assemblies 14 are advancing, usually but not exclusively, up an incline sufficient to help align the products in the valleys 46 formed between the rollers. The roller assemblies 14 advance at a constant rate, being pulled by the chains on either end of the roller assemblies 14. The roller elements 22 are rotated by the sprockets 20 at either end of the shafts 16 which are being turned by a separate moving chain system.

The articles on the conveyor are also being rotated by the roller elements 22 as they pass underneath the camera viewing area 56 such that the articles rotate by at least one full revolution. The cameras 58 will take one or more views of the articles in order to obtain as full a view as possible of all sides of the articles. The required take-off position is determined from the position on the conveyor occupied by article when the final view of the article was taken. Accordingly, once the conveyor 12 passes under the viewing section 56, the roller elements 22 are no longer driven to rotate. This is because when the roller elements 22 are rotating, the articles carried thereupon drift across the valleys 46 and the relative position of the article on the conveyor 12 is not stable. As the take-off position of the article is calculated from the last view of the article taken, in order to be removed at the correct position the article must not have moved from that particular point on the conveyor 12. Articles not ejected from the conveyor 12 are carried by the roller elements 22 through the take-off section 60.

At a first take-off position, articles of a certain size, grade or orientation are flipped up and forward into a cross flow take-off conveyor or flume 62. At a further take-off point, articles of a different size, grade or orientation are flipped up and forward into a further cross flow take-off belt or flume located at this position. Long articles such as carrots where orientation is important for subsequent processing or packing, may be selectively removed at different take off points depending on the direction the carrot is facing (orientation). When flipped up into the cross flow take-off conveyance, the carrot remains pointing the same direction as it lay in the valley 46 formed between the roller elements 22, because a plurality of flip levers 28 are actuated at the same time across its length to propel the carrot without reorientating.

The combination of a simple carrier system, sophisticated camera and processing system and simple forward flip lever system for removal of the products into overhead cross conveyances results in an economic way to size, grade and orient a wide variety of fruit and vegetable commodities.

What is claimed is:

1. A method of grading articles including fruits and vegetables, comprising the steps of:

a) conveying the articles to be graded:

b) monitoring the articles as they are conveyed;

c) acting to remove at least one grade of article in response to data provided during the monitoring step; and d) removing articles by selectively actuating an array of article removal devices located below said articles, said article removal devices being actuated by signals generated during the monitoring step;

characterised by the step of:

e) causing the article removing devices to contact the articles to be removed, said contact imparting upward momentum to the articles, the upward momentum causing the articles to be propelled or flipped upwards away from the surface of the conveyor, in a direction substantially parallel with the direction of the conveying of the articles, towards a discharge location.

2. A method of guiding articles according to claim 1 characterised in that said array of said article removal devices are conveyed with the articles and actuated by an array of actuators controlled by signals generated during monitoring of the articles.

3. A method of grading articles according to claim 2 characterised in that said array of article removal devices being disposed in rows across the conveying width of said article.

4. A method of grading articles according to claim 1 characterised by conveying said articles on a belt-type conveyor comprising successive rows of said article removal devices interspersed with rows of drivable, rotatable article turning elements and driving said article turning elements to align said articles with rows for said monitoring step.

5. A method of grading articles according to claim 1 characterised by interrupting the drive to said device turning elements between said monitoring step and said step of actuating said article removal devices.

6. A method of grading according to claim 1 characterised by the articles being turned prior to monitoring whereby the articles on the conveyor can be presented in the preferred position for monitoring.

7. A method of grading according to claim 6 characterised by the step of suspending the turning of the articles after the monitoring step whereby migration of the article is prevented.

8. A method of grading articles including fruit and vegetables, comprising the steps of: locating the articles on a spool or roller conveyor element; causing the articles on the conveyor to pass under an inspection device at which the articles are inspected and scanned as they pass to produce inspection data; analyzing the inspection data from said articles by a data processing system, said data being processed and classified according to a predetermined criteria; and causing a selection of said articles to be removed from the conveyor in response to said classification, wherein during the step of removal, the article is caused to be propelled upwards from the surface of the conveyor, in a direction substantially parallel with the direction of the conveying of the articles, towards a discharge device.

9. Apparatus for inspecting and sorting articles including fruit and vegetables, comprising:

a) at least one drivable spool or roller conveyor means onto which articles are presented;

b) an inspection device under which the articles are conveyed which inspects and scans the articles as they pass;

c) a control system for analysing and processing the data obtained and adapted to classify the articles according to shape and/or size and/or defects present;

d) an array of article removal devices located below said articles which may be actuated to displace/remove articles from the roller conveyor means in response to such classification; and e) at least one discharge location at which articles displaced/removed from the roller conveyor are received;

characterised in that:

f) the actuation of said article removal device causes contact with the articles to be removed, thereby imparting upward momentum thereto, said upward momentum causing the article to be propelled or flipped upwards away from the surface of the roller conveyor, in a direction substantially parallel to the direction of the conveying of the articles, towards a discharge location.

10. Apparatus for grading articles according to claim 9 characterised in that said article removal devices are located on the conveyor and are actuated by an array of actuators controlled by signals generated when the articles are viewed or inspected.

11. Apparatus for grading articles according to claim 10 characterised by said article removal devices being disposed in rows across the conveying width of said article.

12. Apparatus for grading articles according to claim 9 characterised in that said conveyor comprises a belt-type conveyor on which are provided successive rows of said article removal devices interspersed with rows of drivable, rotatable turning elements, said article-turning elements acting to turn said articles to align them within said rows to facilitate inspection.

13. A apparatus for grading articles according to claim 12 characterised in that said article turning elements act to turn said articles as they pass the inspection device whereby a full view of the article is obtained.

14. Apparatus for grading articles according to claim 12 characterised in that drive means to said article turning elements is suspended after the articles have passed the inspection device whereby said articles cease to turn thus preventing migration.

15. Apparatus for grading articles according to claim 9, characterized in that at least two conveyors are provided, the second conveyor, which receives articles ejected from the first conveyor, is located above the first conveyor which presents the articles to be graded.

16. Apparatus for grading articles according to claim 15 characterised in that said second conveyor comprises a water flume.

17. Apparatus for grading articles including fruit and vegetables, comprising:

a) apparatus having at least one drivable spool or roller conveyor means onto which articles are presented;

b) a viewing or inspection device under which the articles are conveyed which inspects and scans the articles as they pass;

c) a control system for analyzing and processing the data obtained and adapted to classify articles according to shape and/or size and/or defects present; and d) a mechanism for displacing/removing articles from the roller conveyor means in response to said classification, and at least one discharge location at which articles displaced/removed from the roller conveyor are received;

characterized in that:

e) the actuation of said article removal devices causes the articles to be propelled upwardly from the surface of the roller conveyor, in a direction substantially parallel to the direction of the conveying articles, towards a discharge location.

18. Apparatus according to claim 17 characterised in that the mechanism for sorting comprises an array of article removing devices mounted on said roller conveyor means.

19. Apparatus according to claim 18 characterised in that said article removing devices comprise flip levers or projections.

20. Apparatus according to claim 19 characterised in that said flip lever comprises a round portion with an aperture, a substantially horizontally extending arm portion, and a substantially vertically extending leg portion.

21. Apparatus according to claim 20 characterised in that said flip lever comprises a round portion with an aperture, a substantially horizontally extending arm portion, a substantially vertically extending leg portion, all being moulded as a single body.

22. Apparatus according to claim 20 characterised in that said arm portion extends in a direction opposite to that of the flow of articles on the conveyor.

23. Apparatus according to claim 19 characterised in that said projections or flip levers are mounted at intervals along the length of the roller conveyor means.

24. Apparatus according to claim 23 characterised in that said projections or flip levers are actuable independently of the roller elements of said roller conveyor.

25. Apparatus according to claim 24 characterised in that the arm portion of said projections or flip levers are caused to move in a generally upwardly direction in relation to the conveyor.

26. Apparatus according to claim 25 characterised in that on actuation the arm portion of said projections or flip levers are caused to move in a generally upwardly direction between successive rollers of the convertor so as to contact the article to be removed from the conveyor.

27. Apparatus according to claim 22 characterised in that said flip levers or projections are caused to move by an actuating cylinder located beneath the conveyor.

28. Apparatus according to claim 27 characterised in that said actuating cylinder is formed with a boot.

29. Apparatus according to claim 28 characterised in that said actuating cylinder and boot move into the path of the leg portion of the flip lever acting as a trip therefor.

30. Apparatus according to claim 25 characterised by said projections or flip levers being of finger-like form.

31. Apparatus according to claim 29 characterised by said projections or flip levers being inclined forwardly with respect to their own direction of rotation.

32. Apparatus according to claim 17 characterised in that the inspection device comprises a camera scanning unit.

33. Apparatus according to claim 32 characterised in that said camera scanning unit is mounted overhead above the conveyor so as to enable the articles to be viewed as they pass beneath.

34. Apparatus according to claim 33 characterised in that said camera scanning unit is linked to the control system which includes a central processing unit wherein data obtained from analysing the image of each article scanned is collated, the article classified according to the required criteria and a discharge position established for each article according to the classification.

35. Apparatus according to claim 34 characterised in that tracking means is provided on the conveyor so as to enable the position of each article to be followed thus facilitating removal of the particular article from the conveyor on reaching the required position.

36. Apparatus according to claim 17 characterised in that said discharge conveyor comprises a transverse overhead take-out conveyor to collect and deliver articles placed therein.

37. Apparatus according to claim 17 characterised in that said discharge conveyor comprises a water flume to collect and deliver articles placed therein.

* * * * *